US008387651B2

(12) United States Patent
Threlkeld

(10) Patent No.: US 8,387,651 B2
(45) Date of Patent: Mar. 5, 2013

(54) SELF-DRAINING FROST-FREE FAUCET

(76) Inventor: David Michael Threlkeld, Belleville, IL (US)

( * ) Notice: Subject to any disclaimer, the term of this patent is extended or adjusted under 35 U.S.C. 154(b) by 469 days.

(21) Appl. No.: 12/327,524

(22) Filed: Dec. 3, 2008

(65) Prior Publication Data

US 2010/0132821 A1 Jun. 3, 2010

(51) Int. Cl.
*F16L 5/00* (2006.01)

(52) U.S. Cl. ..... 137/360; 137/302; 137/614.13

(58) Field of Classification Search ..... 137/217, 137/218, 360, 862, 866, 887, 302, 304, 306, 137/614.13
See application file for complete search history.

(56) References Cited

U.S. PATENT DOCUMENTS

| | | | | |
|---|---|---|---|---|
| 2,435,338 | A * | 2/1948 | Booth | 137/599.15 |
| 3,424,189 | A * | 1/1969 | Woodford | 137/218 |
| 3,952,770 | A * | 4/1976 | Botnick | 137/360 |
| 4,644,970 | A * | 2/1987 | Lowry | 137/625.41 |
| 4,909,270 | A | 3/1990 | Enterante, Sr. et al. | |
| 4,971,097 | A | 11/1990 | Hunley, Jr. et al. | |
| 5,158,105 | A | 10/1992 | Conway | |
| 5,228,471 | A | 7/1993 | Hoeptner, III | |
| 5,392,805 | A * | 2/1995 | Chrysler | 137/218 |
| 5,740,831 | A | 4/1998 | DeNardo et al. | |
| 5,947,150 | A * | 9/1999 | Ryan | 137/360 |
| 6,142,172 | A | 11/2000 | Shuler et al. | |
| 6,668,852 | B1 | 12/2003 | Williamson | |
| 6,712,089 | B1 | 3/2004 | Heflin | |
| 6,752,167 | B1 | 6/2004 | Stanaland et al. | |
| 7,140,390 | B2 * | 11/2006 | Berkman et al. | 137/614.2 |
| 2006/0201553 | A1 * | 9/2006 | Poskin et al. | 137/360 |

* cited by examiner

*Primary Examiner* — Craig Schneider
*Assistant Examiner* — Kevin Murphy
(74) *Attorney, Agent, or Firm* — Armstrong Teasdale LLP

(57) ABSTRACT

A valve assembly for a faucet includes a spout, a valve stem, a first valve, and a second valve. The first valve is rotatably coupled to the valve stem upstream from the spout and is selectively positionable to control a flow of fluid from a fluid source to the spout. The second valve is rotatably coupled to the valve stem for selectively draining fluid from the valve assembly. Further, the second valve is coupled to the first valve such that when the first and second valves are positioned in a first operational position, fluid flows from the source through the spout, and such that when the first and second valves are positioned in a second operational position, fluid is substantially prevented from flowing from the source through the spout and residual fluid within the faucet is gravity drained from the faucet.

19 Claims, 5 Drawing Sheets

SELF-DRAINING FROST-FREE FAUCET

BACKGROUND OF THE INVENTION

This invention relates generally to frost-free faucets and more particularly, to frost-free faucets that are self-draining.

Frost-free faucets have long been used to control a flow of water externally to a building. At least some known faucets include a shut-off valve coupled within the end of an elongated pipe, or housing, located within a wall or a warmer interior portion of the building of which the wall is a part. The shut-off valve is operated by a valve stem that extends through the housing and is coupled to a handle located on an external portion of the wall or building. The handle selectively controls the flow of water through the faucet to a spigot located externally to the building. The shut-off valve enables the flow of water to be stopped at a point within the wall or building that is upstream from the elongated pipe. Residual water that remains in the housing or elongated pipe is gravity drained from the faucet through the spigot. As such, the faucet may be used in sub-freezing environments without requiring seasonal draining and with little risk of water undesirably freezing in the faucet.

Although residual water is generally drained from such faucets, if a hose, or other flow device, is coupled to the faucet spigot, residual water in the hose and faucet may be prevented from draining. As a result, residual water trapped within the faucet between the shut-off valve and the attached hose, or other flow device, may freeze and expand when the spigot is exposed to sub-freezing temperatures. More specifically, when the temperature reaches sub-freezing, as trapped residual water freezes, the expansion of the frozen water increases the pressure on the inside of the faucet. Depending on the amount of water that has frozen, the pressure exerted on the inside of the housing may become greater than the pressure that the housing can withstand. Over time, such pressure may cause cracks to develop and/or may cause the faucet to fail. Moreover, depending on the damage sustained by the faucet, water may undesirably leak into the interior of the building.

BRIEF DESCRIPTION OF THE INVENTION

In one aspect, a valve assembly for a faucet is provided. The valve assembly includes a spout, a valve stem, a first valve, and a second valve. The first valve is rotatably coupled to the valve stem upstream from the spout and is selectively positionable to control a flow of fluid from a fluid source to the spout. The second valve is rotatably coupled to the valve stem for selectively draining fluid from the valve assembly. Further, the second valve is coupled to the first valve such that when the first and second valves are positioned in a first operational position, fluid flows from the fluid source through the spout, and such that when the first and second valves are positioned in a second operational position, fluid is substantially prevented from flowing from the fluid source through the spout and residual fluid within the faucet is gravity drained from the faucet.

In another aspect, a faucet is provided. The faucet includes a handle, a valve assembly, and a housing. The valve assembly includes a spout, a valve stem, a first valve and a second valve. The first valve is rotatably coupled to the valve stem upstream from the spout and is selectively positionable to control a flow of fluid from a fluid source to the spout. The second valve is rotatably coupled to the valve stem for selectively draining fluid from the valve assembly. Further, the second valve is coupled to the first valve such that when the first and second valves are positioned in a first operational position, fluid flows from the fluid source through the spout, and such that when the first and second valves are positioned in a second operational position, fluid is substantially prevented from flowing from the fluid source through the spout and residual fluid within the faucet is gravity drained from the faucet. The handle is rotatably coupled to the valve assembly, and the valve assembly is positioned within the housing.

In a further aspect, a valve assembly is provided. The valve assembly includes a valve stem, a first valve, a second valve, and a housing. The first valve is rotatably coupled to the valve stem upstream from the spout and is selectively positionable to control a flow of fluid from a fluid source to the spout. The second valve is rotatably coupled to the valve stem for selectively draining fluid from the valve assembly. Further, the second valve is coupled to the first valve such that when the first and second valves are positioned in a first operational position, fluid flows from the fluid source through the spout, and such that when the first and second valves are positioned in a second operational position, fluid is substantially prevented from flowing from the fluid source through the spout and residual fluid within the faucet is gravity drained from the faucet. The housing includes a primary drain configured to drain a flow of primary fluid and residual fluid from the faucet when the first and second valves are positioned in the first operational position. Further, the housing includes a secondary drain configured to drain residual fluid from the faucet when the first and second valves are positioned in the second operational position.

DETAILED DESCRIPTION OF THE INVENTION

Figure 1:
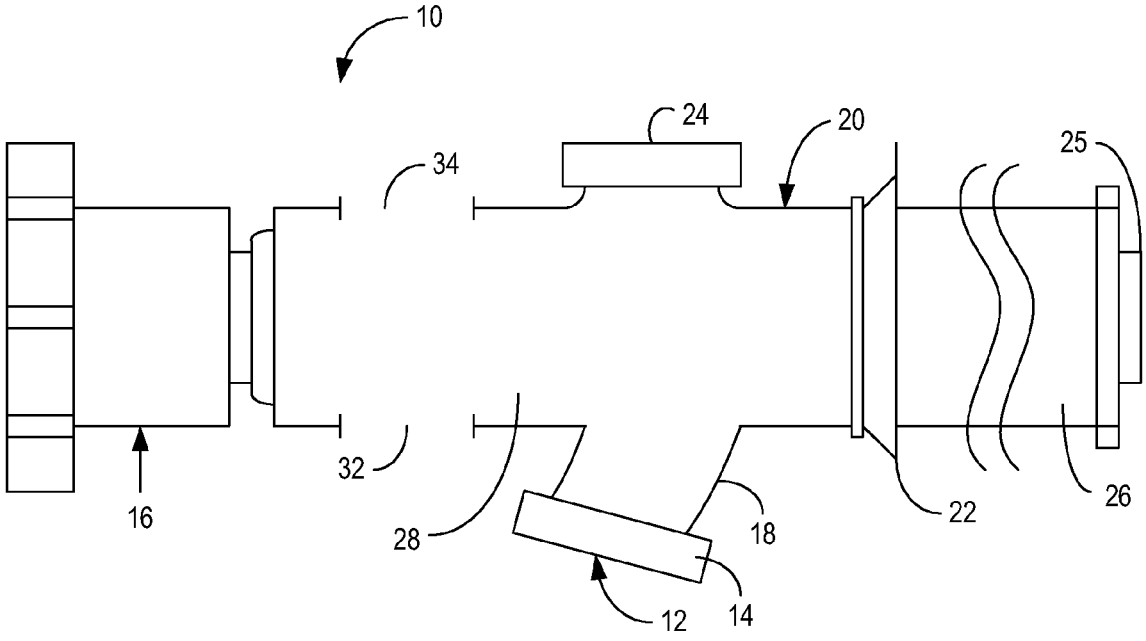
FIG. 1 is a side view of an exemplary frost-free self draining faucet.

FIG. 1 is a side view of an exemplary frost-free self-draining faucet 10 including a housing or a valve body 20, a spout 12, a drain opening 32, and a vent 34. In the exemplary embodiment, the faucet 10 also includes a handle 16 and a vacuum breaker 24. Moreover, in the exemplary embodiment, the faucet 10 includes a flange 22 for coupling the faucet to a wall or other structure (not shown in FIG. 1). Additionally, in the exemplary embodiment, the spout 12 includes a drain conduit 18 that includes a threaded portion 14 that enables a hose or other apparatus (not shown in FIG. 1) to be coupled to the spout 12. Alternatively, the spout can be adapted to couple to a hose or other apparatus using any other conventional hose coupling means.

The housing or valve body 20 is hollow and includes an upstream portion 26 and a downstream portion 28. The housing 20 is in flow communication with the spout 12, and the housing 20 and spout 12 are securely coupled together via welding, soldering or any other suitable method that secures housing 20 and spout 12 together. In another embodiment, housing 20 and spout 12 are integrally formed together. The housing 20 also includes, in the exemplary embodiment, a threaded portion 25 that enables the housing 20 to be secured to another component (not shown) such as a water source (not shown). Alternatively, the housing 20 could be coupled to another component using any other conventional means.

Figure 2:
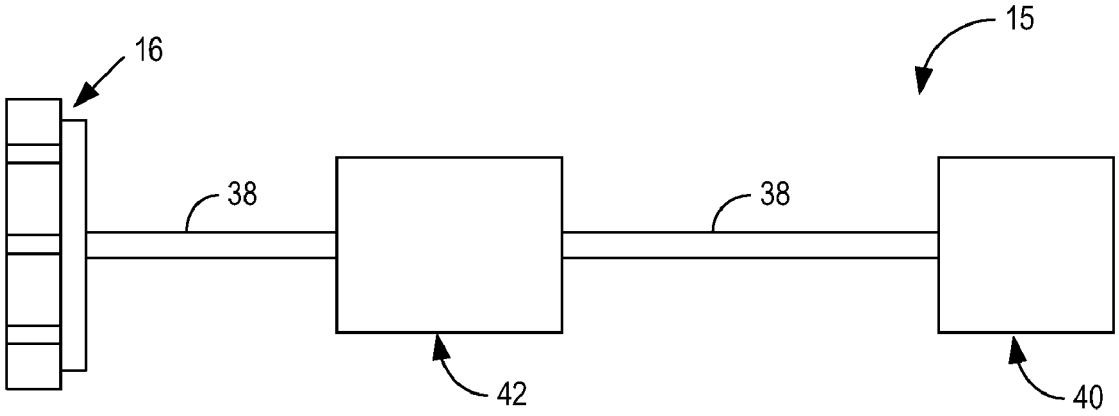
FIG. 2 is a block diagram of a valve assembly that may be used with the frost free self-draining faucet shown in FIG. 1.

FIG. 2 is a block diagram of an exemplary valve assembly 15 that may be used with faucet 10 (shown in FIG. 1). In the exemplary embodiment, valve assembly 15 includes a valve stem 38, a first valve 40, and a second valve 42. Handle 16 is coupled to valve stem 38 for selectively positioning the first and second valves (40 and 42). The handle 16 may be any type of handle known in the art and may include a name plate coupled thereto for conveying information to a consumer regarding its operation. The valve stem 38 is coupled to the handle 16 downstream from the first and second valves 40 and 42, respectfully. Moreover, the first valve 40 and the second valve 42 are coupled to the valve stem 38 such that the first valve 40 is upstream from second valve 42. Valves 40 and 42 may be of any type that allows valve assembly 15 to function as is described herein.

Figure 3:
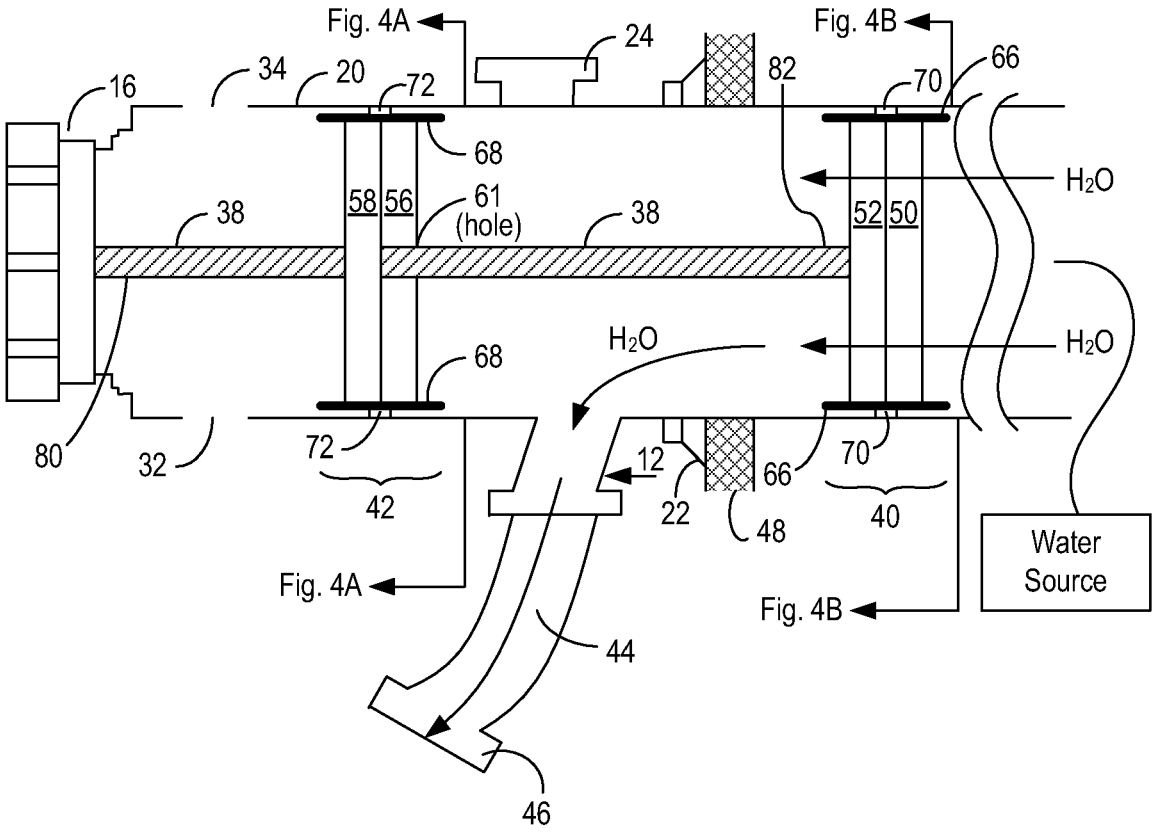
FIG. 3 is an enlarged cross-sectional view of the valve assembly shown in FIG. 2 and in a first operational position within a housing.

FIG. 3 is an enlarged cross sectional view of valve assembly 15 coupled within housing 20 and in a first operational position. Moreover, in FIG. 3, faucet 10 is coupled to a hose 44 including a shut-off mechanism 46. In the exemplary embodiment, faucet 10 is coupled to a wall 48 of a building or structure, such that the first valve 40 is positioned in the interior of the building or structure, and the second valve 42 is positioned externally and may thus be subjected to/exposed to the elements and temperature extremes. The valve assembly 15 may be used in any location, or with any structure, where an ambient air temperature difference between the locations of the first and second valves 40 and 42, respectfully, exists. More specifically, the valve assembly 15 may be used where the ambient temperature of the air surrounding the first valve 40 is lower than the freezing point of fluid channeled therethrough.

In the exemplary embodiment, the first valve 40 includes a first valve seat 50, a first valve disc 52, and a first valve cartridge 66, and the second valve 42 includes a second valve seat 56, a second valve disc 58, and a second valve cartridge 68. In the exemplary embodiment, the first and second valve cartridges 66 and 68, respectfully, each include O-rings 70 and 72 that facilitate preventing leakage of fluid from and around the exterior of first and second valve cartridges 66 and 68, respectively.

In the exemplary embodiment, both the first and second valve seats 50 and 56 use stationary discs that are formed with at least one opening 54 and 60, respectfully, defined therein. Openings 54 and 60 enable fluid to pass through the valve seat 50 and 56, respectively, when the valve 40 or 42 is in an open position, as shown in FIG. 4. In the exemplary embodiment, openings 54 and 60 have a circular cross-section. In an alternative embodiment, openings 54 and 60 may be of any shape that allows valves 40 and 42 to function as described herein. In the exemplary embodiment, first and second valve seats 50 and 56 each include two openings 54 and 60, respectively, defined in the valve seats 50 and 56. In the exemplary embodiment, openings 54 and 60 are orientated diametrically on opposite sides of a center 63 of each valve seat 50 and 56, and such that the openings 50 and 56 are approximately 180° apart. Additionally, both the first and second valve seats 50 and 56 each include fit-up members 51 and 57 located on the diametric opposite sides of each valve seat 50 and 56. Members 51 and 57 are sized and shaped to be received within indentions 53 and 59 defined on the interior surface 67 and 69 of each of the first and second valve cartridges 66 and 68, respectively. Fit-up members 51 and 57 prevent each valve seat 50 and 56, from rotating within its respective valve cartridge 66 and 68. The first and second valve seats 50 and 56, respectively, also include stops 62 and 64, respectively, which extend outward from a downstream surface 75 and 77 of each valve seat 50 and 56, adjacent to each valve disc 52 and 58. In another embodiment, stops 62 and 64 extend outward from an upstream surface of each valve seat 50 and 56, adjacent to each valve disc 52 and 58. Stops 62 and 64 limit the rotation of each valve disc 52 and 58 to a predetermined amount or rotation, during operation of valve assembly 15.

Valve stem 38 extends through an opening defined in second valve seat 56. More specifically, in the exemplary embodiment, opening 61 extends from an upstream surface 78 to a downstream surface 75 of valve seat 56. In the exemplary embodiment, opening 61 is substantially centered within valve seat 56. As such, and as described in more detail below, valve stem 38 can rotate within second valve seat 56 without causing second valve seat 56 to rotate.

In the exemplary embodiment, first and second valve discs 52 and 58 are each butterfly-shaped discs that are sized to completely cover each opening 54 and 60 defined in each respective valve seat 50 and 56. Thus, the first and second valve discs 52 and 58, as described in more detail below, can be separately positioned to substantially prevent the flow of fluid through the openings 54 and 60 when the respective valve 40 and 42 is in a closed position. The first and second valve discs 52 and 58 are also sized such that the flow of fluid through each opening 54 and 60 is substantially unobstructed when the corresponding valve 40 and 42 is in an open position. Alternatively, the valve discs 52 and/or 58 can have any shape such that enables the valve disc 52 or 58 to cover the openings 54 and 60 when each valve 40 and 42 is in a closed position, and such that the valve disc 52 and 58 does not obstruct the flow of fluid through the openings when each valve 40 and 42 is in an open position.

First and second valve discs 52 and 58, respectively, are each coupled to valve stem 38, and valve stem 38 is coupled to handle 16. More specifically, valve stem 38 during use is rotated to selectively position the first and second valve discs 52 and 58 with respect to the first and second valve seats 50 and 56. In one embodiment, valve stem 38 engages the first and second valve discs 52 and 58 via prongs (not shown) that extend into recesses (not shown) formed in the valve discs 52 and 58. In another embodiment, valve stem 38 is selectively coupled to each of the first and second valve discs 52 and 58.

In the exemplary embodiment, the first valve disc 52 is positioned relative to first valve seat 50 and the second valve disc 58 is positioned relative to second valve seat 56 such that rotation of the first and second valve discs 52 and 58 selectively prevents or allows the flow of fluid through the corresponding valve 40 and 42. The valve stem 38 extends through opening 61 and is coupled at a first end 80 to handle 16. An opposite second end 82 of valve stem 38 is operably coupled to first valve disc 52. Moreover, in the exemplary embodiment, the first valve disc 52 is circumferentially offset from the second valve disc 58 by approximately 90° such that when valve assembly 15 is in a first operational position, first valve 40 is open and second valve 42 is closed, and when valve assembly 15 is in a second operational position, first valve 40 is closed and second valve 42 is open. In an alternate embodiment, the first and second valve discs 52 and 58 may be circumferentially offset by any amount that enables valve assembly 15 to function as described herein.

Figure 4A:
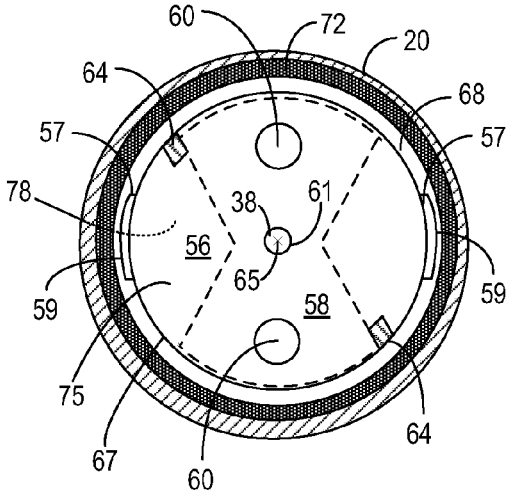
FIG. 4A is a cross-sectional view of the valve assembly shown in FIG. 3 and taken along Line 4A-4A.
Figure 4B:
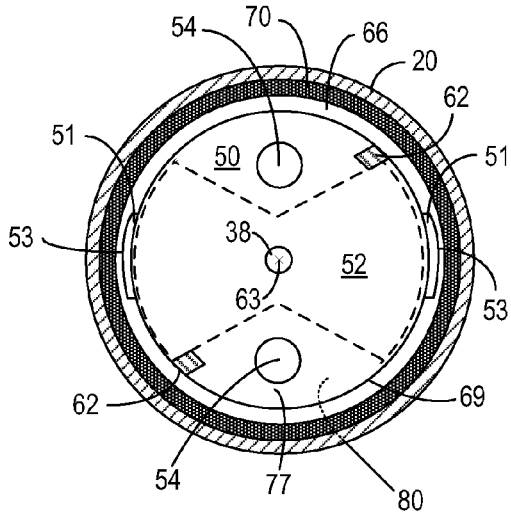
FIG. 4B is a cross-sectional view of the valve assembly shown in FIG. 3 and taken along the line 4B-4B.

During use, fluid may flow unobstructed through valve assembly 15 when valve assembly 15 is in the first operational position, as illustrated in FIG. 3. More specifically, when valve assembly 15 is in the first operational position, the first valve 40 is rotated to the open position, and the second valve 42 is rotated to the closed position, as shown in FIGS. 4A and 4B. Thus, fluid may flow from a fluid source through the first valve 40 and into housing 20. Because the second valve 42 is in a closed position, the fluid will either remain in housing 20, i.e. as residual fluid contained between the first and second valves 40 and 42, or will drain through spout 12. In such an orientation, spout 12 is the primary drain. Moreover, when the valve assembly 15 is in the first operational position, the flow path of the fluid flowing downstream past first valve 40 is dependant on whether or not a shut off mechanism, such as hose stop 46, is coupled to spout 12 and is positioned to prevent the flow of the fluid through the spout. In such an orientation, the fluid will remain in the housing between the first and second valves 40 and 42 as residual fluid. However, if no such apparatus is coupled to spout 12 in such a closed position, the fluid will flow through spout 12 and will exit housing 20.

Figure 6A:
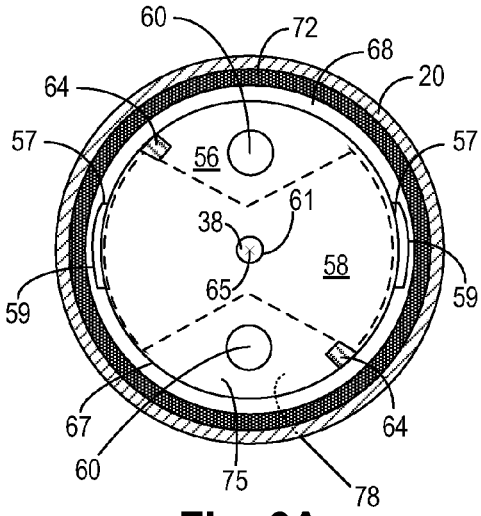
FIG. 6A is a cross-sectional view of the valve assembly shown in FIG. 5 and taken along line 6A-6A.
Figure 6B:
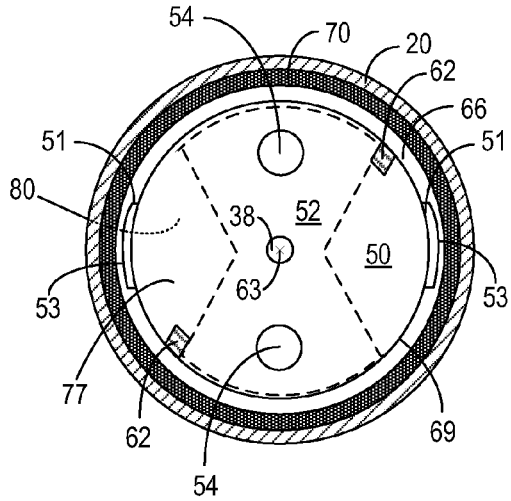
FIG. 6B is a cross-sectional view of the valve assembly shown in FIG. 5 and taken along line 6B-6B.
Figure 5:
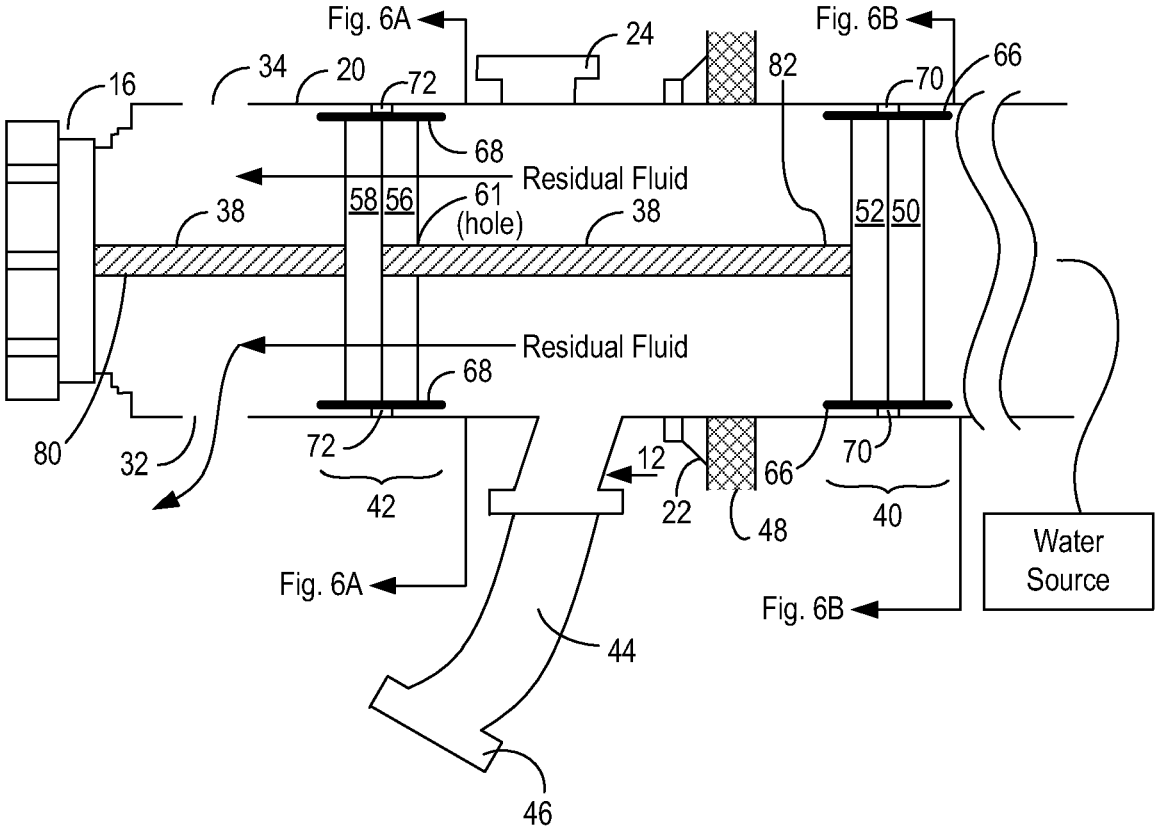
FIG. 5 is a cross-sectional view of the valve assembly shown in FIG. 3 and in a second operational position.

FIG. 5 is a cross-sectional view of valve assembly 15 and illustrates the flow of fluid through valve assembly 15 when valve assembly 15 is in the second operational position. FIGS. 6A and 6B are cross-sectional views of valve assembly 15 taken along lines 6A-6A and 6B-6B, respectively. In the exemplary embodiment, when valve assembly 15 is in the second operational position, first valve 40 is in a closed position, and second valve 42 is in an open position, as shown in FIGS. 6A and 6B. When valve assembly 15 is in such an orientation, any residual fluid in housing 20 between first and second valves 40 and 42 may gravity drain through the second valve 42 and downstream through drain opening 32. More specifically, at least a portion of any residual fluid will exit housing 20 such that the expansion caused by any residual fluid freezing will not increase the pressure inside housing 20 so as to cause housing 20 to rupture.

Described herein is a valve assembly that may be utilized in a wide variety of faucets. In each embodiment, the valve assembly has a first valve rotatably coupled to a valve stem that is selectively positionable to control a flow of fluid from a fluid source to a spout. Further, in each embodiment, the valve assembly has a second valve rotatably coupled to the valve stem. When the first and second valves are in a first operational position, fluid may flow to the spout from the fluid source and when the first and second valves are in a second operational position, fluid is substantially prevented from flowing from the fluid source to the spout. As a result, residual fluid within the faucet gravity drains from the faucet. Accordingly, the risk that a faucet housing will rupture when a hose or other device remains connected thereto during periods of extreme cold is significantly reduced in a cost-effective and reliable manner.

Exemplary embodiments of a valve assembly are described above in detail. The valve assemblies illustrated are not limited to the specific embodiments described herein, but rather, components of each valve assembly may be utilized independently and separately from other components described herein.

While the invention has been described in terms of various specific embodiments, those skilled in the art will recognize that the invention can be practiced with modification within the spirit and scope of the claims.

What is claimed is:

1. A valve assembly for a faucet, said valve assembly comprising:

a housing having an inner surface;

a spout;

a valve stem positioned within said housing;

a first valve positioned within said housing and rotatably coupled to said valve stem upstream from said spout such that said first valve does not translate along a longitudinal axis of said valve stem, said first valve selectively positionable to control a flow of fluid from a fluid source to said spout, said first valve comprising a first valve seat and a first valve disc having at least one opening defined therein, said first valve having a radially outermost surface coupled in sealing contact against the inner surface of said housing such that fluid does not leak between the radially outermost surface of said first valve and the inner surface of said housing, said first valve disc is selectively movable to enable fluid to flow through said at least one opening; and a second valve positioned within said housing and rotatably coupled to said valve stem such that said second valve does not translate along the longitudinal axis of said valve stem, said second valve configured to selectively drain fluid from said valve assembly, said second valve coupled to said first valve such that when said first and second valves are positioned in a first operational position, fluid flows from said fluid source through said spout, and such that when said first and second valves are positioned in a second operational position, fluid is substantially prevented from flowing from the fluid source through said spout and residual fluid within said faucet is gravity drained from the faucet, said second valve downstream from said spout when positioned in said first and second operational positions, and said second valve having a radially outermost surface coupled in sealing contact against the inner surface of said housing in the first operational position and the second operational position such that fluid does not leak between the radially outermost surface of said second valve and the inner surface of said housing.

2. A valve assembly in accordance with claim 1 wherein said housing comprises a drain opening defined therein downstream from said second valve.

3. A valve assembly in accordance with claim 1 wherein said housing further comprises a vent defined therein downstream from said second valve.

4. A valve assembly in accordance with claim 1 further comprising a vacuum breaker configured to substantially prevent a backflow of fluid from the fluid source within said faucet.

5. A valve assembly in accordance with claim 1 wherein said housing extends at least partially through an external wall of a building.

6. A valve assembly in accordance with claim 5 wherein said valve assembly is positioned within said housing such that said first valve is positioned within an interior of the building and said second valve is positioned externally to the building.

7. A valve assembly in accordance with claim 1 wherein said valve assembly further comprises a handle rotatably coupled to said valve stem for selectively rotating said first and second valves to the first and second operational positions.

8. A valve assembly in accordance with claim 1 wherein said spout comprises a drain conduit, said drain conduit comprises a plurality of threads for coupling a hose to said faucet.

9. A faucet comprising:

a handle;

a valve assembly comprising a spout, a valve stem, a first valve and a second valve, said first valve is rotatably coupled to said valve stem upstream from said spout such that said first valve does not translate along a longitudinal axis of said valve stem, said first valve is selectively positionable to control a flow of fluid from a fluid source through said spout, said second valve is rotatably coupled to said valve stem such that said second valve does not translate along the longitudinal axis of said valve stem, said second valve configured to selectively drain fluid from said valve assembly, said second valve coupled to said first valve such that when said first and second valves are positioned in a first operational position, fluid flows to said spout from the fluid source, and such that when said first and second valves are positioned in a second operational position, fluid is substantially prevented from flowing from the fluid source to said spout and residual fluid within the faucet is gravity drained from the faucet, said second valve downstream from said spout when positioned in said first and second operational positions, said handle rotatably coupled to said valve assembly, said second valve comprising a valve disc having at least one opening defined therein, said valve disc is selectively movable to enable fluid to flow through said at least one opening; and a housing having an inner surface, said valve assembly positioned within said housing, wherein said first valve has a radially outermost surface coupled in sealing contact against the inner surface of said housing such that fluid does not leak between the radially outermost surface of said first valve and the inner surface of said housing, and said second valve has a radially outermost surface coupled in sealing contact against the inner surface of said housing in the first operational position and the second operational position such that fluid does not leak between the radially outermost surface of said second valve and the inner surface of said housing.

10. A faucet in accordance with claim 9 wherein said housing comprises a drain opening defined therein downstream from said second valve.

11. A faucet in accordance with claim 9 wherein said housing comprises a vent defined therein downstream from said second valve.

12. A faucet in accordance with claim 9 wherein said handle is rotatably coupled to said valve stem for selectively positioning said first and second valves.

13. A faucet in accordance with claim 9 further comprising a vacuum breaker configured to substantially prevent a backflow of fluid from the fluid source.

14. A faucet in accordance with claim 9 wherein the spout comprises a drain conduit, said drain conduit comprises a plurality of threads for coupling a hose to said faucet.

15. A valve assembly for a faucet comprising:

a valve stem;

a first valve rotatably coupled to said valve stem upstream from a spout such that said first valve does not translate along a longitudinal axis of said valve stem, said first valve selectively positionable to control a flow of fluid from a fluid source to said spout, said first valve comprising a first valve disc having at least one opening defined therein, said first valve disc is selectively movable to enable fluid to flow through said at least one opening;

a second valve rotatably coupled to said valve stem such that said second valve does not translate along the longitudinal axis of said valve stem, said second valve configured to selectively drain fluid from said valve assembly, said second valve coupled to said first valve such that when said first and second valves are positioned in a first operational position, fluid flows to said spout from the fluid source, and such that when said first and second valves are positioned in a second operational position, fluid is substantially prevented from flowing from the fluid source to said spout and residual fluid within the faucet is gravity drained from the faucet, said second valve downstream from said spout when positioned in said first and second operational positions; and a housing comprising a primary drain and a secondary drain, said primary drain configured to drain primary fluid and residual fluid from said housing when said first and second valves are positioned in said first operational position, said secondary drain configured to drain only residual fluid from said housing when said first and second valves are positioned in said second operational position, said housing having an inner surface, wherein said first valve has a radially outermost surface coupled in sealing contact against the inner surface of said housing such that fluid does not leak between the radially outermost surface of said first valve and the inner surface of said housing, and said second valve has a radially outermost surface coupled in sealing contact against the inner surface of said housing in the first operational position and the second operational position such that fluid does not leak between the radially outermost surface of said second valve and the inner surface of said housing.

16. A valve assembly in accordance with claim 15 wherein said housing further comprises a vent defined therein downstream from said second valve.

17. A valve assembly in accordance with claim 15 wherein said valve assembly further comprises a handle rotatably coupled to said valve stem for selectively positioning said first and second valves.

18. A valve assembly in accordance with claim 15 wherein said valve assembly further comprises a vacuum breaker configured to substantially prevent a backflow of fluid from the fluid source within the faucet.

19. A valve assembly in accordance with claim 15 wherein said primary drain comprises a threaded portion to facilitate coupling a hose to said spout.

* * * * *